US008434280B2

(12) United States Patent
Liberman

(10) Patent No.: US 8,434,280 B2
(45) Date of Patent: May 7, 2013

(54) MODULAR BUILDING UNITS

(75) Inventor: Barnet L. Liberman, New York, NY (US)

(73) Assignee: Barnet L. Lieberman, New York, NY (US)

( * ) Notice: Subject to any disclaimer, the term of this patent is extended or adjusted under 35 U.S.C. 154(b) by 487 days.

(21) Appl. No.: 12/286,232

(22) Filed: Sep. 29, 2008

(65) Prior Publication Data

US 2009/0094915 A1 Apr. 16, 2009

Related U.S. Application Data

(63) Continuation-in-part of application No. 12/080,105, filed on Apr. 1, 2008.

(60) Provisional application No. 60/921,413, filed on Apr. 2, 2007, provisional application No. 60/921,405, filed on Apr. 2, 2007.

(51) Int. Cl.
*E04B 1/00* (2006.01)

(52) U.S. Cl.
USPC ..... 52/259; 52/223.5; 52/582.1

(58) Field of Classification Search ..... 52/418, 52/582.1, 587.1, 250, 251, 252, 258, 223.4, 52/223.5, 223.6, 223.7, 223.8, 223.9, 223.11, 52/223.13, 319, 295, 296, 849, 253, 259, 52/283

See application file for complete search history.

(56) References Cited

U.S. PATENT DOCUMENTS

| | | | | |
|---|---|---|---|---|
| 2,611,262 | A * | 9/1952 | Dodson et al. | 52/223.13 |
| 2,819,692 | A * | 1/1958 | Johnson et al. | 109/50 |
| 3,261,135 | A * | 7/1966 | Knabe | 52/127.12 |
| 3,621,626 | A * | 11/1971 | Tylius | 52/223.13 |
| 3,713,259 | A * | 1/1973 | Tkach | 52/111 |
| 3,831,332 | A | 8/1974 | Weese | |
| 4,558,797 | A | 12/1985 | Mitchell | |
| 4,583,336 | A * | 4/1986 | Shelangoskie et al. | 52/250 |
| 4,907,660 | A | 3/1990 | Staggs et al. | |
| 5,123,220 | A * | 6/1992 | Simenoff | 52/252 |
| 5,596,853 | A | 1/1997 | Blaney et al. | |
| 6,074,101 | A | 6/2000 | Bloom | |
| 6,237,297 | B1 | 5/2001 | Paroly | |
| 6,588,296 | B2 | 7/2003 | Wessel | |
| 6,978,572 | B1 | 12/2005 | Bernklau et al. | |
| 2005/0241918 | A1 | 11/2005 | Alldredge et al. | |

* cited by examiner

*Primary Examiner* — William Gilbert
*Assistant Examiner* — Theodore Adamos
(74) *Attorney, Agent, or Firm* — Cozen O'Connor

(57) ABSTRACT

Presented is a modular building unit that includes a top end with a top surface, a bottom end with a bottom surface; a first plate assembly embedded in the top end, and a second plate assembly embedded in the bottom end. The first plate assembly includes a first plate with a threaded hole, a plurality of anchoring rods coupled to the first plate and embedded in the top end, and a threaded rod mated with the threaded hole. One end of the threaded rod is embedded in the top end and the other end extends out of the top end. The second plate assembly includes a second plate with an unthreaded hole, and a plurality of anchoring rods coupled to the second plate and embedded in the bottom end.

16 Claims, 10 Drawing Sheets

MODULAR BUILDING UNITS

CROSS REFERENCE TO RELATED APPLICATIONS

This application is a continuation-in-part of U.S. patent application Ser. No. 12/080,105 which was filed with the U.S. Patent and Trademark Office on Apr. 1, 2008. Priority is claimed for this invention and application, corresponding application(s) having been filed in United States on Apr. 2, 2007, No. 60/921,413 and No. 60/921,405 filed Apr. 2, 2007 respectively.

FIELD OF THE INVENTION

The present invention relates generally to modular building units, and more particularly to various modular components and methods for assembling and disassembling the various modular components to construct modular building structures.

BACKGROUND OF THE INVENTION

Modular units are commonly used for constructing residential and industrial structures because they can be partially assembled/constructed at a factory and transported via train, truck, or ship to a construction site for assembly into a complete structure. However, once the modular units are assembled into complete structures, existing methods of assembly do not allow for easy disassembly so that the modular units can be segregated into components and/or reused for constructing new structures when the original structure is no longer needed, such as a temporary office annex. Consequently, many otherwise sound modular units are wasted because they cannot be disassembled without being damaged or destroyed.

SUMMARY OF THE INVENTION

In one aspect, the invention involves a modular building unit. The modular building unit includes a top end comprising a top surface, a bottom end comprising a bottom surface, a first plate assembly embedded in the top end, and a second plate assembly embedded in the bottom end. The first plate assembly includes a first plate that defines a threaded hole. A plurality of anchoring rods are coupled to the first plate and are embedded in the top end. The first plate assembly further includes a threaded rod that includes a proximal end and a distal end. The threaded rod is mated with the threaded hole. The distal end of the threaded rod extends out of the top end and is configured to be received in an unthreaded hole of another modular building unit. The proximal end of the threaded rod is embedded in the top end. The second plate assembly includes a second plate that defines an unthreaded hole that is configured to receive a threaded rod from another modular building unit. A plurality of anchoring rods are coupled to the second plate and are embedded in the bottom end.

In one embodiment, the modular building unit further includes an access port that provides access to the second plate assembly. In another embodiment, the first and second plates comprise steel. In still another embodiment, the plurality of anchoring rods coupled to the first plate and the plurality of anchoring rods coupled to the second plate are made of steel or rebar. In yet another embodiment, the threaded rod is made of steel or rebar. In another embodiment, the modular building unit is a concrete column. In still another embodiment, the second plate assembly further includes a third plate coupled to the anchoring rods coupled to the second plate. The third plate defines a threaded hole. In yet another embodiment, the proximal end of the threaded rod is mated with the threaded hole of the third plate. In another embodiment, the modular building unit is a sheer wall. In other embodiments, the first plate assembly further includes a washer and a nut coupled to the threaded rod. In another embodiment, the modular building unit further includes a washer and a nut coupled to the proximal end of the threaded rod. In still another embodiment, the modular building unit further includes a fireproof panel configured to cover the access port. In yet another embodiment, the diameter of the unthreaded hole is greater than the diameter of the threaded bar. In another embodiment, the modular building unit further includes a cylinder embedded in the top end and in which a portion of the threaded bar is disposed. In yet another embodiment, the modular building unit further includes a cylinder that extends between the first plate assembly and the second plate assembly and in which a portion of the threaded bar is disposed.

In another aspect, the invention involves a plate assembly configured to be at least partially embedded in a modular building unit to enable the modular building unit to be coupled to an adjacent modular building unit having a complementary plate assembly at least partially embedded therein. The plate assembly includes a plate that includes a first surface and a second surface opposite the first surface, and that defines a hole that extends between the first surface and the second surface. The first surface faces toward the modular building unit and the second surface faces away from the modular building unit. The plate assembly further includes a plurality of anchoring rods the each include a first end and a second end. The first ends are coupled to the first surface of the plate and are configured to be embedded in the modular building unit.

In one embodiment, the hole is unthreaded. In another embodiment, the hole is threaded. In still another embodiment, the plate assembly includes a threaded rod mated with the threaded hole where the rod is configured to be received in an unthreaded hole of a plate assembly at least partially embedded in an adjacent modular building unit. In some embodiments, the plate is steel, and the anchoring rods are made of steel or rebar. In yet another embodiment, the plate assembly further includes another plate that is configured to be embedded in the modular building unit. The another plate includes a first surface and a second surface opposite the first surface, and defines an unthreaded hole with a diameter greater than the diameter of the threaded rod. The unthreaded hole extends between the first and second surfaces. The first surface is coupled to the second ends of the plurality of anchoring rods such that first surface of the plate and the first surface of the another plate face each other. In other embodiments, the threaded bar is made of steel or rebar and the modular building unit is a concrete column or a sheer wall.

BRIEF DESCRIPTION OF THE DRAWINGS

In the drawings, like reference characters refer to the same parts throughout the different views. Also, the drawings are not necessarily to scale, emphasis instead generally being placed upon illustrating the principles of the invention.

DETAILED DESCRIPTION OF THE PRESENTLY PREFERRED EMBODIMENTS

The present invention involves various modular units and methods for assembling and disassembling the various modular units to construct reusable modular building structures. In particular, the invention involves plate assemblies used for connecting concrete columns and sheer walls.

Figure 1A:
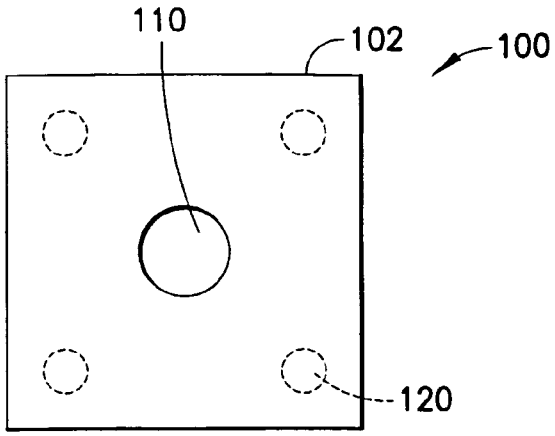
FIG. 1A is an illustrative top view of a female plate assembly, according to one embodiment of the invention.
Figure 1B:
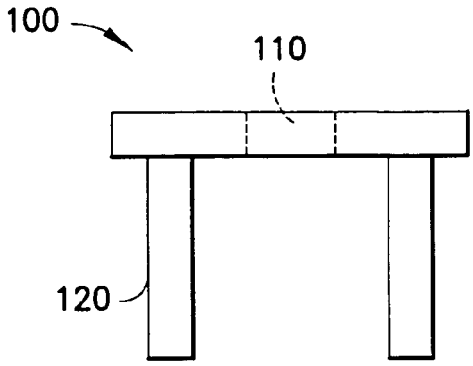
FIG. 1B is an illustrative side view of the female plate assembly of FIG. 1A.

Referring to FIGS. 1A and 1B, in one embodiment, a female plate assembly 100 is shown. The female plate assembly 100 includes a plate 102 defining an unthreaded hole 110 and four anchoring rods 120 connected to the plate 102, one anchoring rod 120 disposed at each corner of the plate 102.

Figure 2:
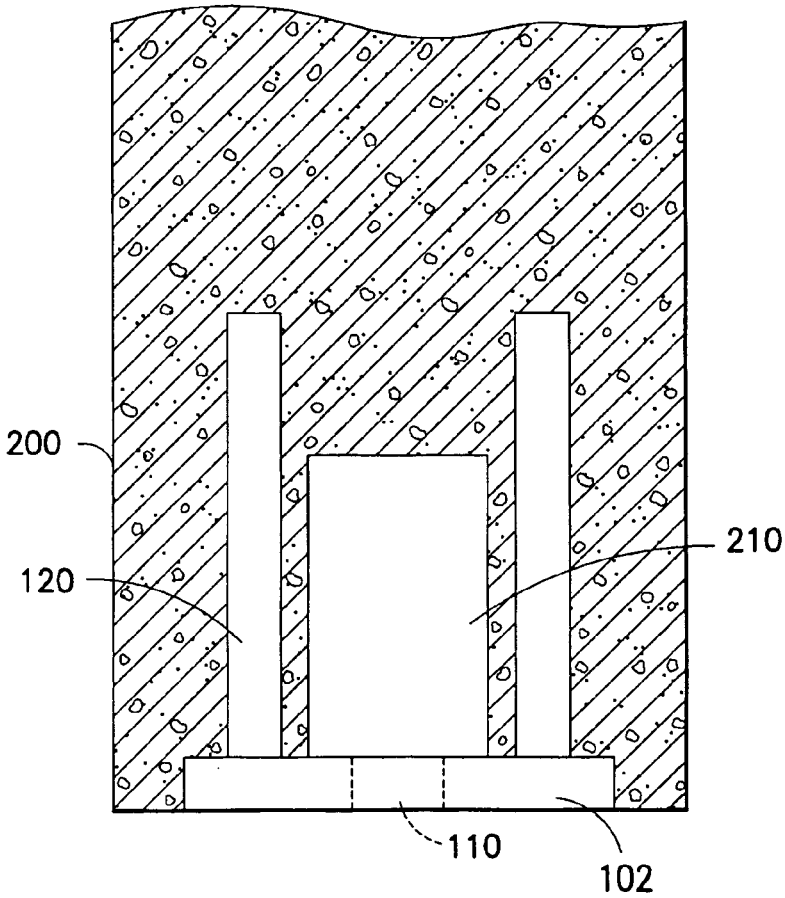
FIG. 2 is an illustrative cross-sectional side view of the female plate assembly of FIG. 1A embedded in a concrete column.

Referring to FIG. 2, in one embodiment concrete column 200 with a female plate assembly 100 embedded therein is shown. The column 200 includes an access port 210, which allows access to the female plate assembly 100.

To construct the column 200, concrete is poured into a column mold and female plate assembly 100 is embedded in the wet concrete with the plate 102 flush with the bottom surface of the column 200. A filler block is placed between the anchoring rods 120. When the concrete hardens, the filler block is removed leaving the access port 210. The anchoring rods 120 anchor the female plate assembly 100 in the column 200.

In one embodiment, the plate 102 is made of steel and the anchoring rods 120 are made of steel or rebar.

Figure 3A:
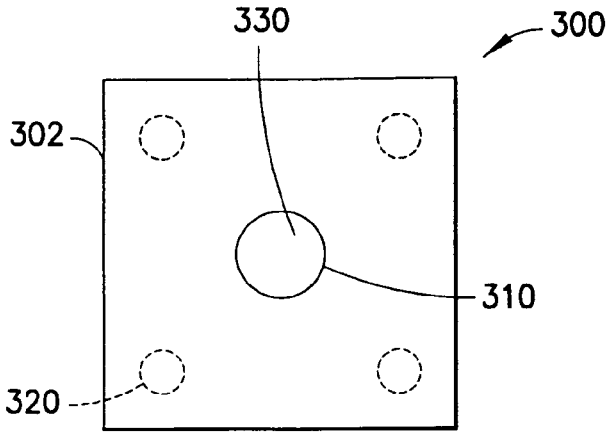
FIG. 3A is an illustrative top view of a male plate assembly, according to one embodiment of the invention.
Figure 3B:
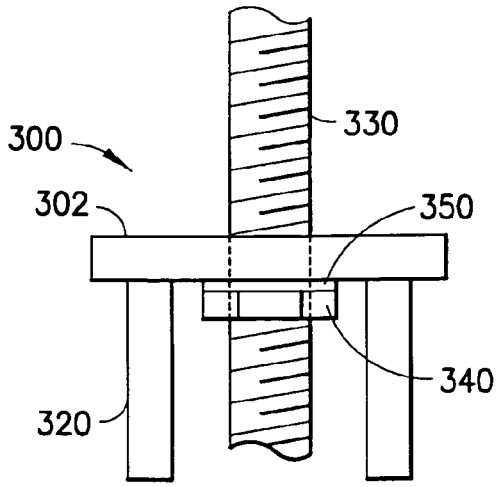
FIG. 3B is an illustrative side view of the male plate assembly of FIG. 3A.

Referring to FIGS. 3A and 3B, in one embodiment, a male plate assembly 300 is shown. The male plate assembly 300 includes a plate 302 defining a threaded hole 310 and four anchoring rods 320 connected to the plate 302, one anchoring rod 320 disposed at each corner of the plate 302. The male plate assembly 300 further includes a threaded rod 330 screwed through the threaded hole 310 and secured with nut 340 and washer 350.

Figure 4:
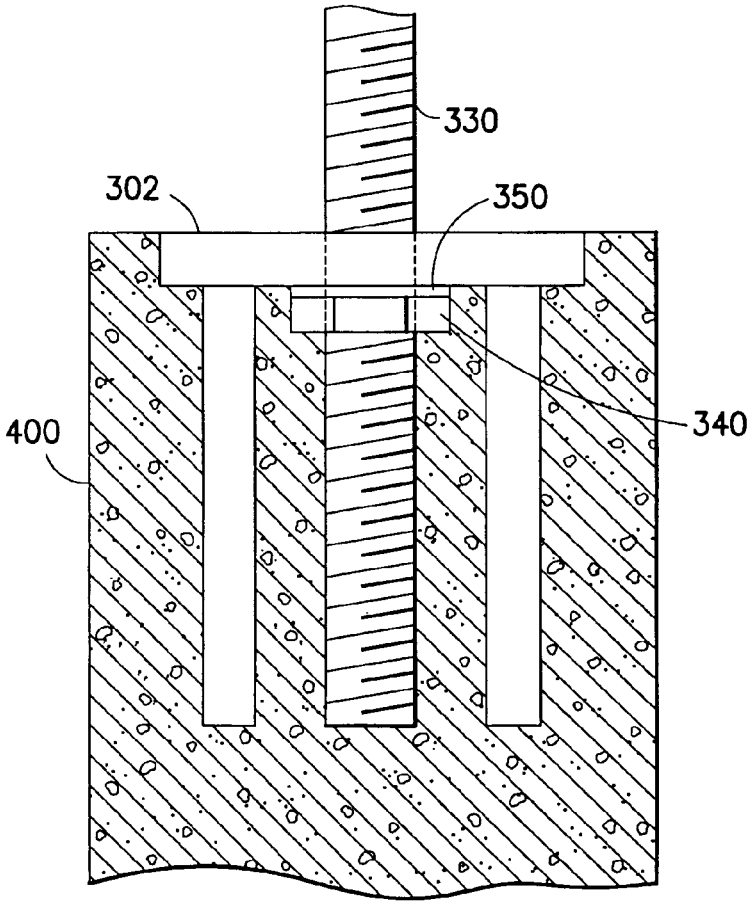
FIG. 4 is an illustrative cross-sectional side view of the male plate assembly of FIG. 3A embedded in a concrete column.

Referring to FIG. 4, in one embodiment, concrete column 400 with a male plate assembly 300 embedded therein is shown. To construct the column 400, concrete is poured into a column mold and male plate assembly 300 is embedded in the wet concrete with the plate 302 flush with the top surface of the column 400 such that the threaded rod 330 extends beyond the top surface of the column 400. The anchoring rods 320 anchor the male plate assembly 300 in the column 400. Additionally, an end of the threaded rod 330 is also embedded in the concrete.

In one embodiment, the plate 302 is made of steel, the anchoring rods 320 are made of steel or rebar, and the threaded rod is made of steel or rebar. In another embodiment, the portion of the threaded rod 330 that is embedded in the concrete does not have to be threaded.

Figure 5:
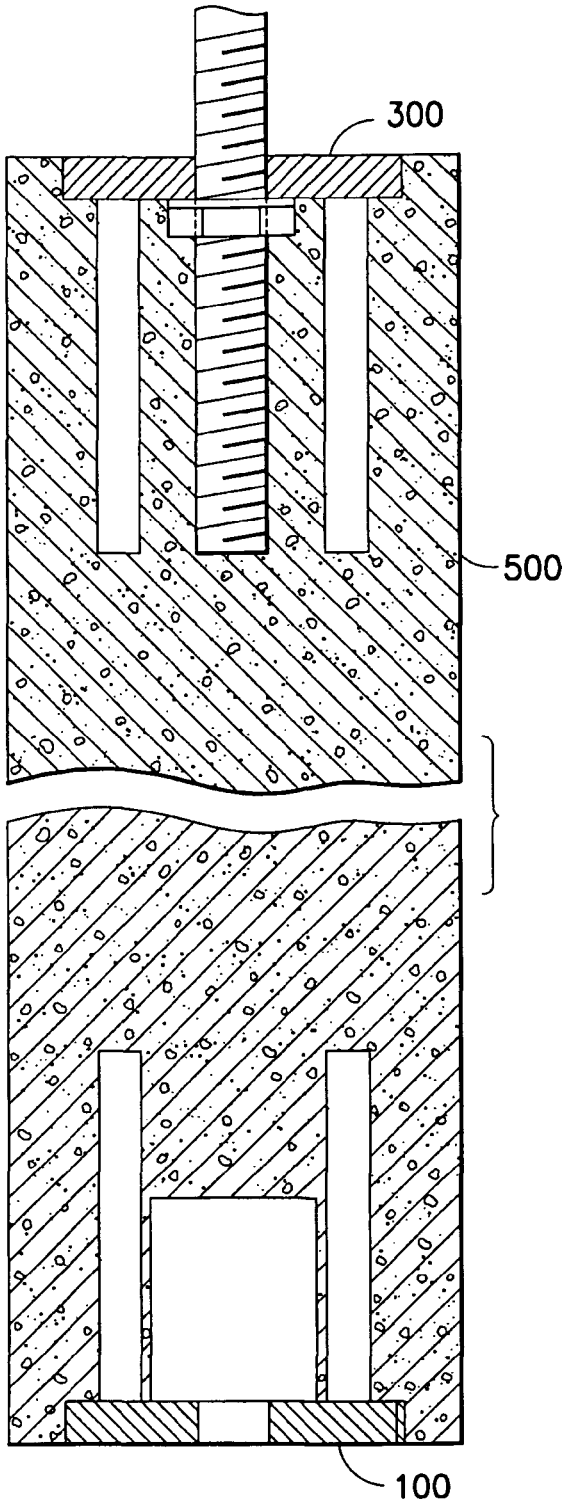
FIG. 5 is an illustrative cross-sectional side view of a female plate assembly and a male plate assembly embedded in concrete column, according to one embodiment of the invention.

Referring to FIG. 5, in one embodiment, a complete concrete column 500 is shown. The complete column 500 includes a female plate assembly 100 embedded in the bottom end of the column 500 and a male plate assembly 300 embedded in the top end of the column 500.

Figure 6:
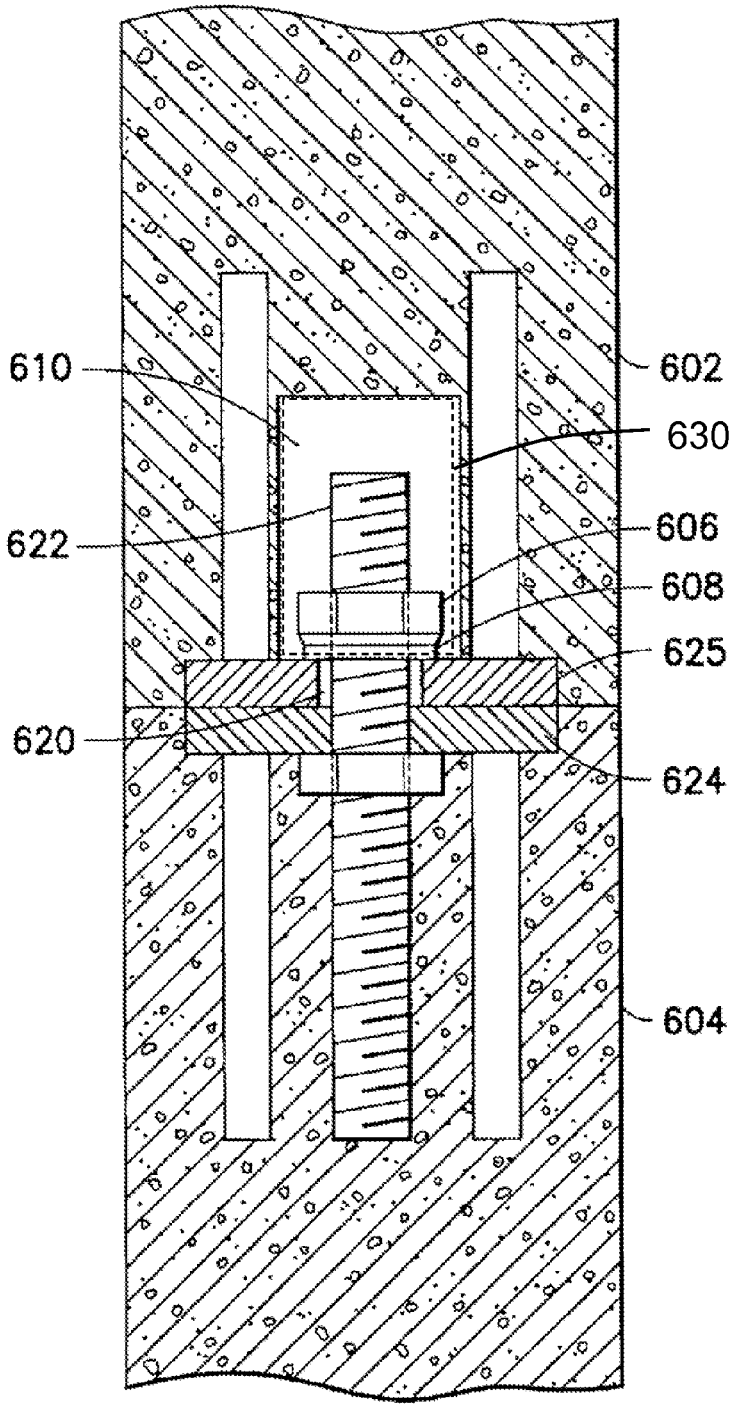
FIG. 6 is an illustrative cross-sectional side view of a female plate assembly mated with a male plate assembly, according to one embodiment of the invention.

Referring to FIG. 6, in one embodiment, a top column 602 is shown coupled to a bottom column 604. To couple the columns 602 and 604, the top column 602 is lowered on top of the bottom column 603 and the threaded rod 622 of the embedded male plate assembly 624 of the bottom column 604 is inserted into the unthreaded hole 620 of the embedded female assembly 625. The unthreaded hole 620 of the female assembly 625 has a diameter that is greater than the diameter of the threaded rod 622 to allow for easier alignment. After the bottom surface of top column 602 is flush with the top surface of the bottom column 604, a washer 608 and nut 606 are put on the end of the threaded rod 622 that extends into the access port 610. The access port 610 is then covered with a fireproof cover 630 after the nut 606 has been tightened.

To connect the bottom column 604 to a foundation or a floor slab, a male plate assembly is embedded in the top surface of the foundation or floor slab and the bottom column 604 is connected as described above. Likewise, to connect the top column 602 to a ceiling slab, a female plate assembly is embedded in the bottom surface of the ceiling slab and top column 602 is connected as described above.

Figure 7:
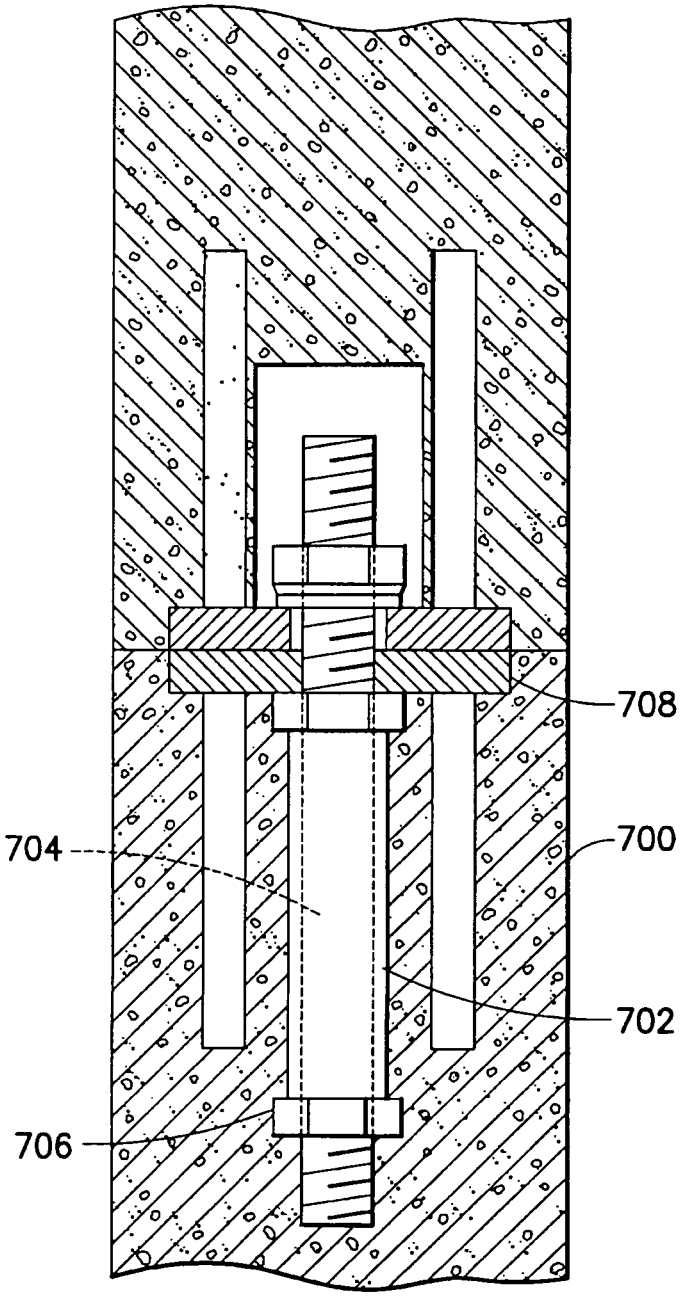
FIG. 7 is an illustrative cross-sectional side view of a female plate assembly mated with a male plate assembly, according to another embodiment of the invention.

Referring to FIG. 7, in another embodiment, instead of the threaded rod 704 directly embedded in the concrete column 700, a cylinder 702 is instead embedded in the concrete column 700. The threaded rod 704 is disposed inside the embedded cylinder 702 (which acts as a sleeve for the threaded rod 704) and secured with a nut 706 at one end and connected to the male plate assembly 708 at the other end, as described in detail above. In another embodiment, the portion of the threaded rod 704 that is disposed in the cylinder 702 does not have to be threaded. In one embodiment, the cylinder 702 is made of steel. In other embodiments, the cylinder 702 is made of other rigid materials known in the art.

Figure 8A:
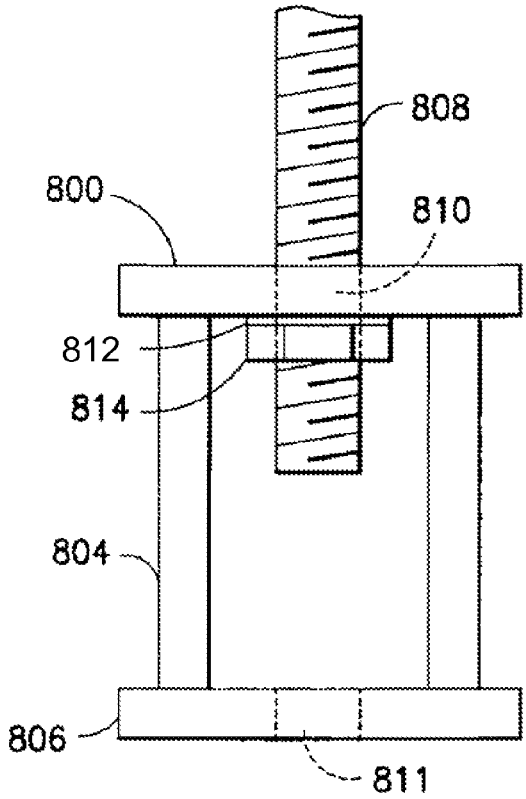
FIG. 8A is an illustrative cross-sectional side view of a sheer wall plate assembly, according to one embodiment of the invention.
Figure 8B:
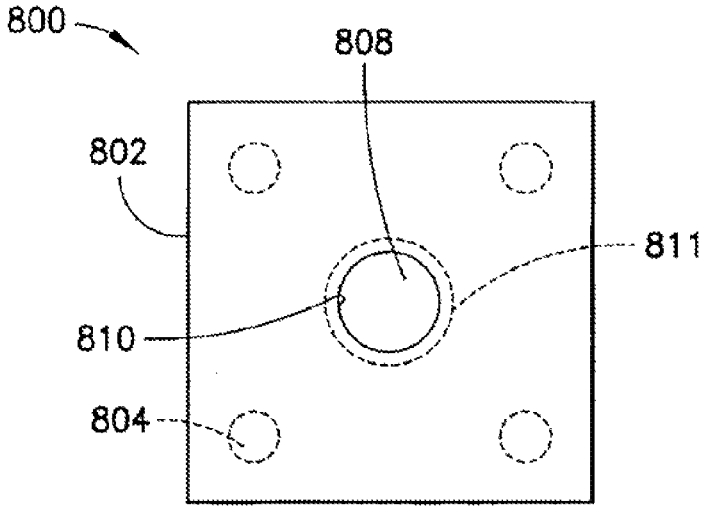
FIG. 8B is an illustrative cross-sectional top view of a sheer wall plate assembly, according to one embodiment of the invention.

Referring to FIGS. 8A and 8B, in one embodiment, a sheer wall plate assembly 800 is shown. The sheer wall plate assembly 800 includes a top plate 802 defining a threaded hole 810, a bottom plate 806 defining an unthreaded hole 811, and four anchoring rods 804 connected to the top and bottom plates 802 and 806, with one anchoring rod 804 disposed at each corner of the plates 802 and 806. The top plate 802 further includes a threaded rod 808 screwed through the threaded hole 810 and secured with nut 814 and washer 812.

Figure 9:
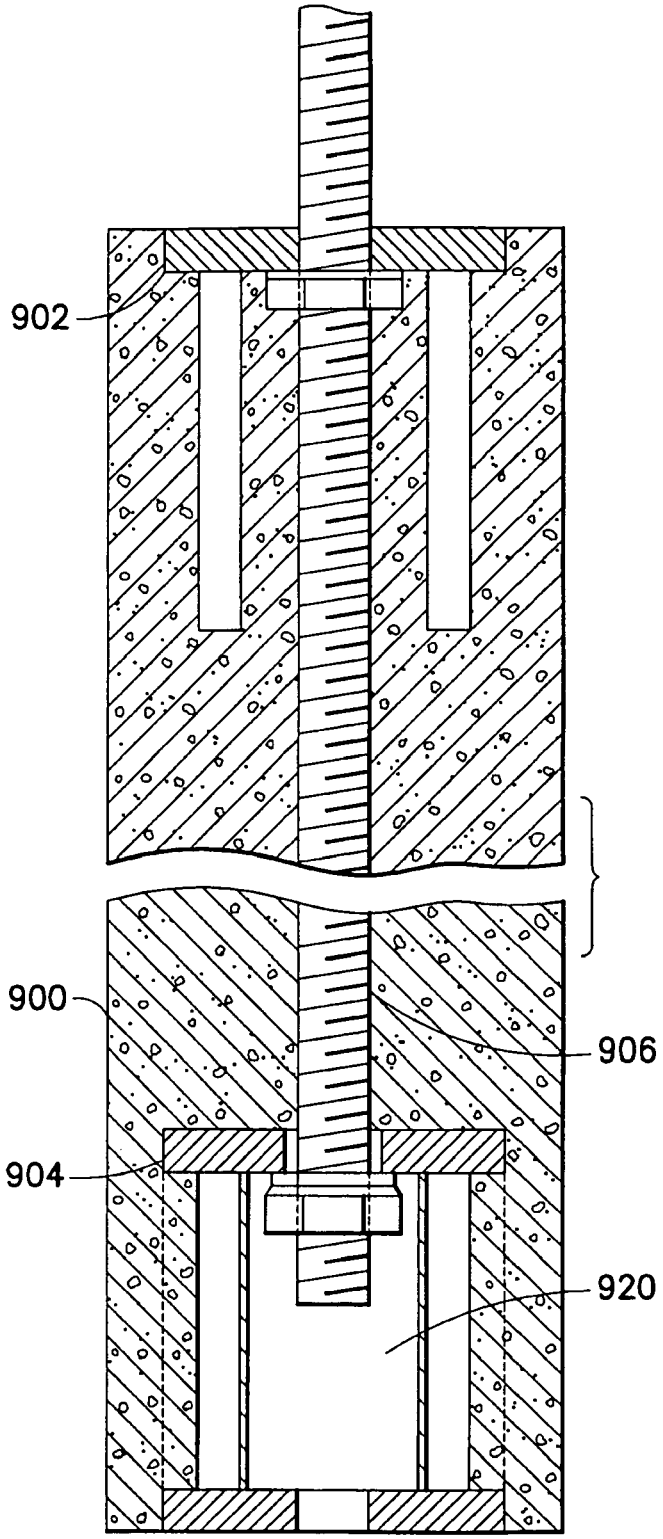
FIG. 9 is an illustrative cross-sectional side view of a male plate assembly and a sheer wall plate assembly embedded in sheer wall, according to one embodiment of the invention.

Referring to FIG. 9, in one embodiment, a complete sheer wall 900 is shown. The complete sheer wall 900 includes a sheer wall plate assembly 904 embedded in the bottom end of the sheer wall 900 and a male plate assembly 902 embedded in the top end of the sheer wall 900. The threaded rod 906 extends from the sheer wall assembly 904, through the sheer wall 900, forms part of the male plate assembly 902 (as described above), and extends out of the top surface of the sheer wall 900. The sheer wall 900 also includes an access port 920, which allows access to the sheer wall plate assembly 904.

In another embodiment, the portion of the threaded rod 906 that extends through the sheer wall 900 does not have to be threaded.

Figure 10:
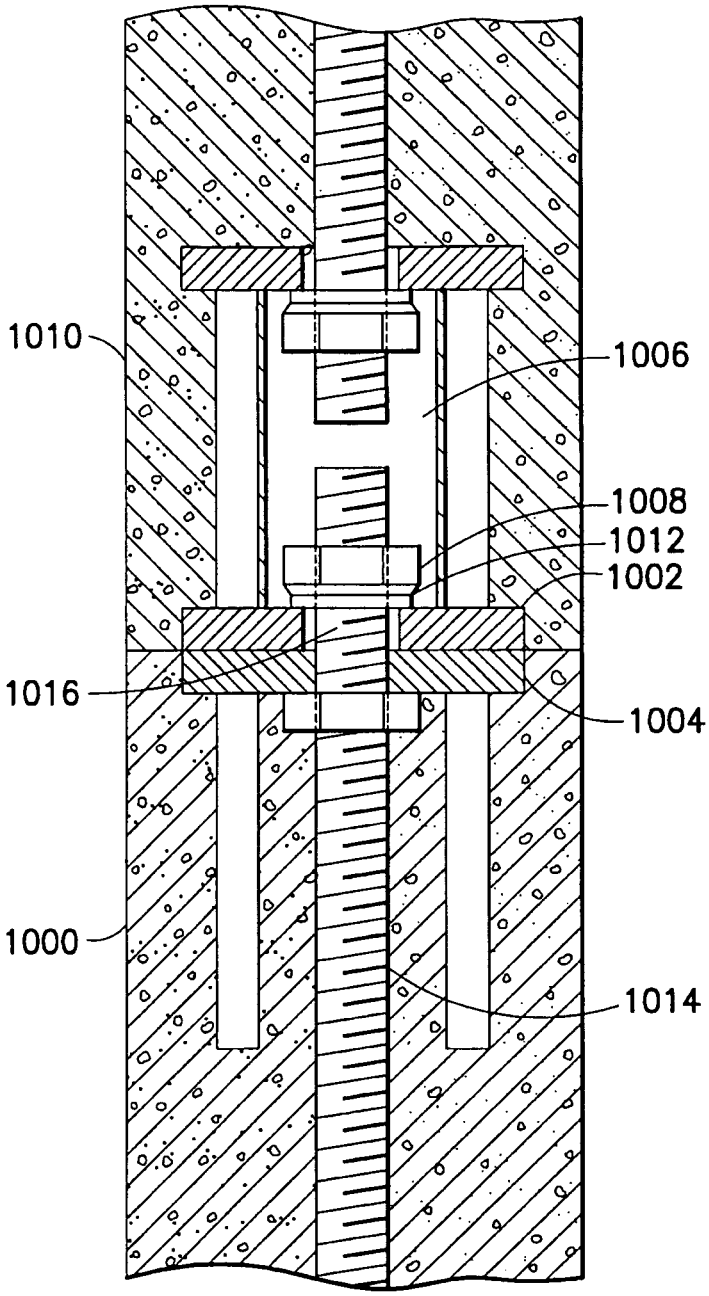
FIG. 10 is an illustrative cross-sectional side view of a male plate assembly mated with a sheer wall plate assembly, according to one embodiment of the invention.

Referring to FIG. 10, in one embodiment, a top sheer wall 1010 is shown coupled to a bottom sheer wall 1000. To couple the top and bottom sheer walls 1010 and 1000, the top sheer wall 1010 is lowered on top of the bottom sheer wall 1000 and the threaded rod 1014 of the embedded male plate assembly 1004 of the bottom sheer wall 1000 is inserted into the unthreaded hole 1016 of the embedded sheer wall assembly 1002. The unthreaded hole 1016 of the sheer wall assembly 1002 has a diameter that is greater than the diameter of the threaded rod 1014 to allow for easier alignment. After the bottom surface of top sheer wall 1010 is flush with the top surface of the bottom sheer wall 1000, a washer 1012 and nut 1008 are put on the end of the threaded rod 1014 that extends into the access port 1006. The access port 1006 is then covered with a fireproof cover after the nut 1008 has been tightened.

To connect the bottom sheer wall 1000 to a foundation or a floor slab, a male plate assembly is embedded in the top surface of the foundation or floor slab and the bottom sheer wall 1000 is connected as described above. Likewise, to connect the top sheer wall 1010 to a ceiling slab, a female plate assembly is embedded in the bottom surface of the ceiling slab and the top sheer wall 1010 is connected as described above.

In one embodiment, the rod 1014 is tensioned (i.e., nut 1008 is tightened) before the concrete is fully cured (pre-stressed). In another embodiment, the rod 1014 is tensioned (i.e., nut 1008 is tightened) after the concrete is fully cured (post-stressed).

Figure 11:
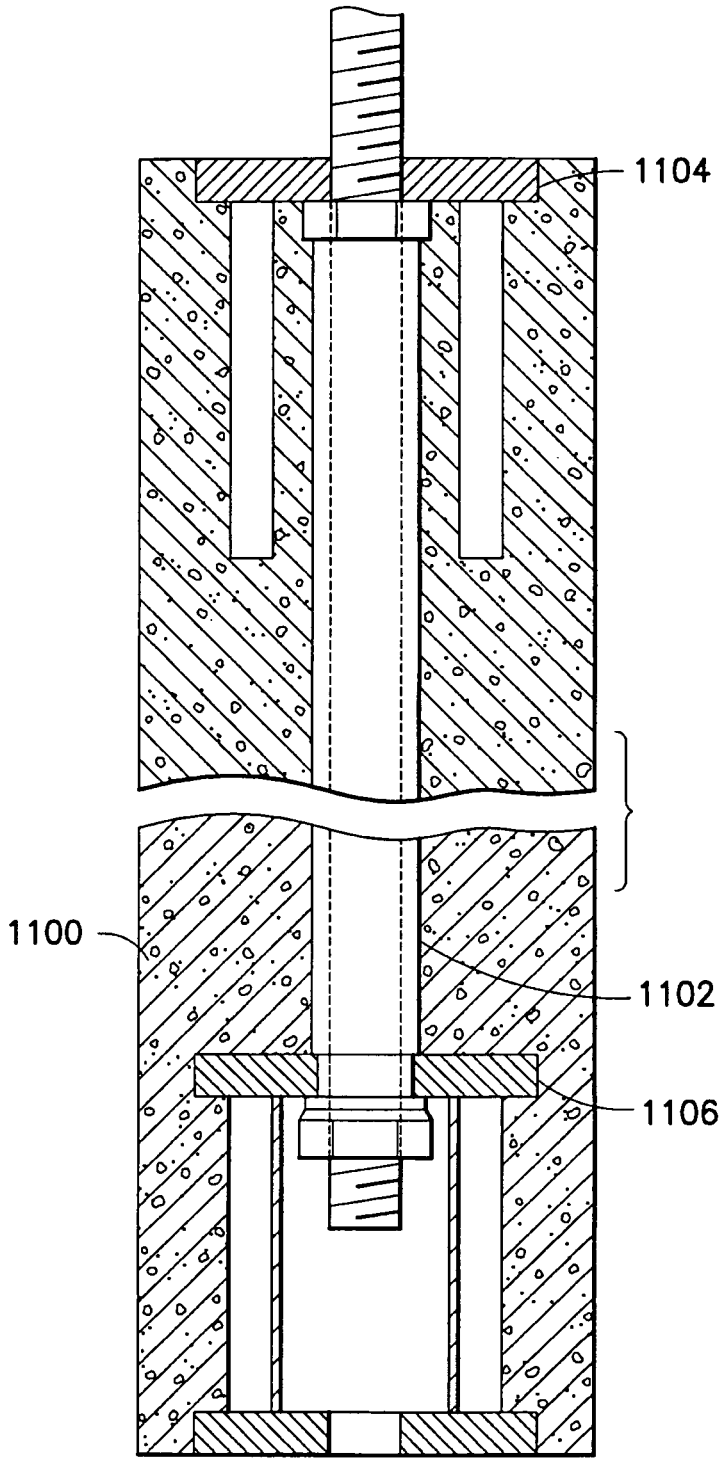
FIG. 11 is an illustrative cross-sectional side view of a male plate assembly and a sheer wall plate assembly embedded in sheer wall, according to another embodiment of the invention.

Referring to FIG. 11, in another embodiment, instead of the threaded rod being directly embedded in the sheer wall 1100, a cylinder 1102 is instead embedded in the sheer wall 1100. The threaded rod 1104 is disposed inside the embedded cylinder 1102 (which acts as a sleeve for the threaded rod 704) and secured at one end to the sheer wall plate assembly 1106 and at the other end to the male plate assembly 1104, as described in detail above. In another embodiment, the portion of the threaded rod 1104 that is disposed in the cylinder 1102 does not have to be threaded. In other embodiments, the cylinder 1102 is made of other rigid materials known in the art.

Figure 12:
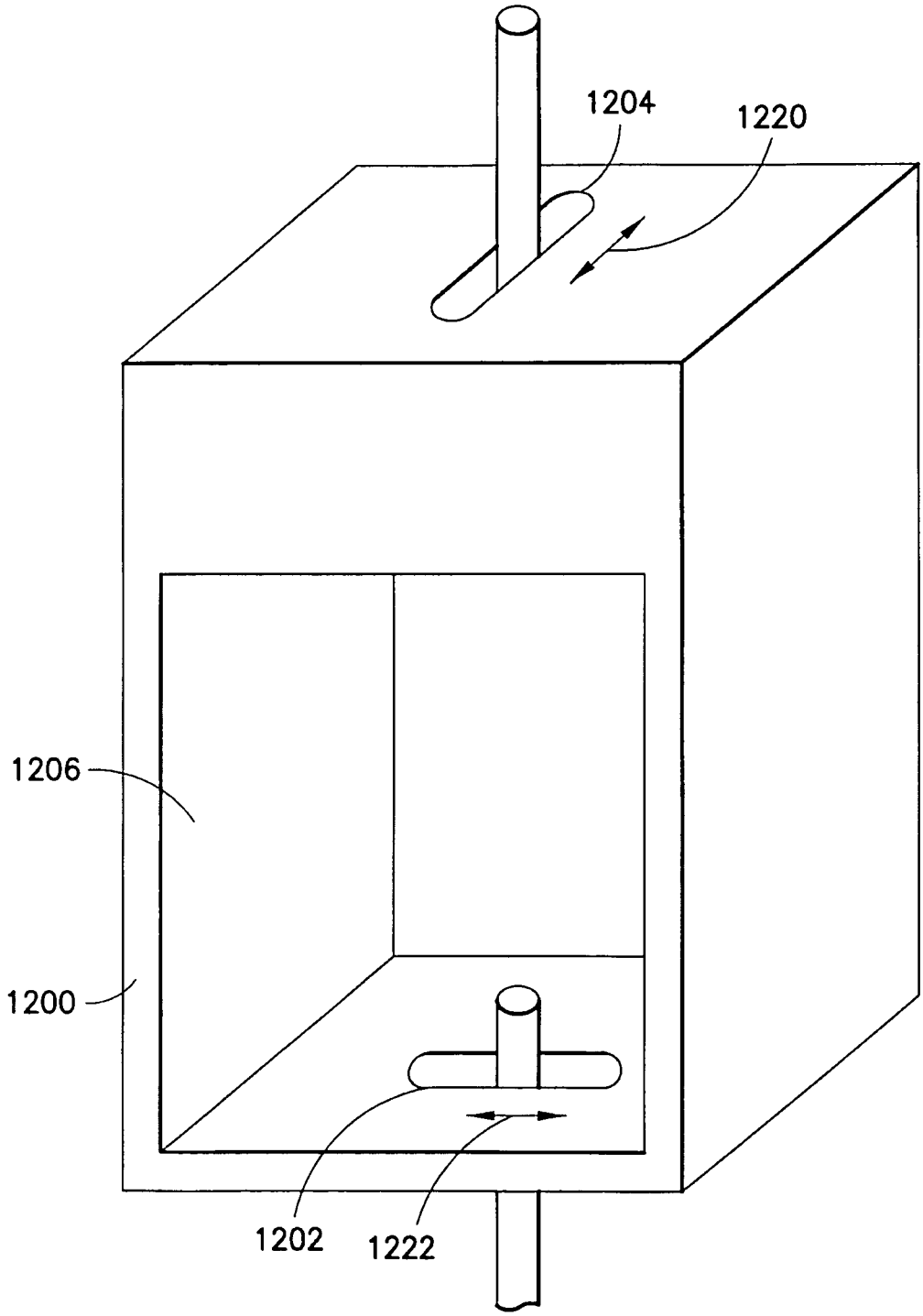
FIG. 12 is an illustrative perspective view of a sheer wall with an alignment slot in the bottom surface and an alignment slot in the top surface, according to one embodiment of the invention.

Referring to FIG. 12, in another embodiment, a perspective view of a sheer wall 1200 with an alignment slot 1202 in the bottom surface and an alignment slot 1204 in the top surface is shown. In this embodiment, slots 1202 and 1204 are arranged perpendicular to each other to allow the sheer wall 1200 and/or a threaded rod to have increased freedom of movement (as shown by arrows 1220 and 1222) to facilitate easy alignment of the sheer wall 1200 with another sheer wall.

In other embodiments, dry packing is disposed between the plates of the male and female or more male and sheer wall plate assemblies to allow for small positional adjustments of the columns or sheer walls to be made using shims, for example.

In other embodiments, there no vertically mechanical fixtures disposed in the modular building units other than those specifically designed to carry vertical mechanical distribution. The various modular units are delivered complete and are immediately ready for assembly. There is no need for mechanical or wet trades to enter the units. All connections for fire suppression, alarm, water, waste, gas, condenser water loop, condensate, electric, fresh air, and exhaust are disposed laterally to outside the unit. These connections are also mechanical and may be easily disconnected at a later date.

Variations, modifications, and other implementations of what is described herein may occur to those of ordinary skill in the art without departing from the spirit and scope of the disclosed subject matter. Further, the various features of the embodiments described herein also can be combined, rearranged, or separated without departing from the spirit and scope of the disclosed subject matter. Accordingly, the invention is not to be defined only by the preceding illustrative description.

What is claimed:

1. A modular building unit, comprising:

a first end comprising an outermost planar surface;

a second end comprising an outermost planar surface;

a first plate assembly embedded in the first end, the first plate assembly comprising a first plate positioned so as to be flush with the outermost planar surface of the first end, the first plate defining a threaded hole, a plurality of anchoring rods coupled to the first plate and embedded in the first end, and a threaded rod comprising a proximal end and a distal end, the threaded rod being mated with the threaded hole, the distal end extending out of the first end and configured to be received in an unthreaded hole of another modular building unit, and the proximal end extending at least partially into the first end; and a second plate assembly embedded in the second end, the second plate assembly comprising a second plate positioned so as to be flush with the outermost planar surface of the second end, the second plate defining an unthreaded hole configured to receive a threaded rod from another modular building unit, and a plurality of anchoring rods coupled to the second plate and embedded in the second end.

2. The modular building unit of claim 1 further comprising an access port providing access to the second plate assembly.

3. The modular building unit of claim 2 further comprising a fireproof panel configured to cover the access port.

4. The modular building unit of claim 1, wherein the first and second plates comprise steel.

5. The modular building unit of claim 1 wherein the plurality of anchoring rods coupled to the first plate and the plurality of anchoring rods coupled to the second plate comprise one of steel or rebar.

6. The modular building unit of claim 1, wherein the threaded rod comprises one of steel or rebar.

7. The modular building unit of claim 1, wherein the modular building unit is a concrete column.

8. The modular building unit of claim 1, wherein the second plate assembly further comprises a third plate coupled to the anchoring rods coupled to the second plate, the third plate defining an unthreaded hole.

9. The modular building unit of claim 8, wherein the threaded rod extends through modular building unit and the proximal end of the threaded rod is mated with the unthreaded hole of the third plate using a fastener.

10. The modular building unit of claim 9, wherein the modular building unit is a sheer wall.

11. The modular building unit of claim 9 further comprising a washer and a nut coupled to the proximal end of the threaded rod.

12. The modular building unit of claim 9 further comprising a cylinder extending between the first plate assembly and the second plate assembly and in which a portion of the threaded bar is disposed.

13. The modular building unit of claim 1, wherein the first plate assembly further comprises a washer and a nut coupled to the threaded rod.

14. The modular building unit of claim 1, wherein the diameter of the unthreaded hole is greater than the diameter of the threaded bar.

15. The modular building unit of claim 1 further comprising a cylinder embedded in the first end and in which a portion of the threaded bar is disposed.

16. A modular building unit, comprising:

a first end comprising a first surface;

a second end comprising a second surface;

a first plate assembly embedded in the first end, the first plate assembly comprising a first plate positioned so as to be flush with the first surface of the first end, the first plate defining a threaded hole, a plurality of anchoring rods coupled to the first plate and embedded in the first end, and a threaded rod comprising a proximal end and a distal end, the threaded rod being mated with the threaded hole, the distal end extending out of the first end and configured to be received in an unthreaded hole of another modular building unit, and the proximal end extending at least partially into the first end; and a second plate assembly embedded in the second end, the second plate assembly comprising a second plate positioned so as to be flush with the second surface of the second end, the second plate defining an unthreaded hole configured to receive a threaded rod from another modular building unit, and a plurality of anchoring rods coupled to the second plate and embedded in the second end, wherein the first plate and the second plate each define a planar surface and when the modular building unit is connected to another modular building unit, the planar surface of the first plate of the modular building unit is in an abutting relationship with the planar surface of the second plate of the other modular building unit; or the planar surface of the second plate of the modular building unit is in an abutting relationship with the planar surface of the first plate of the other modular building unit.

* * * * *